US007654646B2

(12) United States Patent
Tanuma

(10) Patent No.: US 7,654,646 B2
(45) Date of Patent: Feb. 2, 2010

(54) INK JET HEAD

(75) Inventor: Chiaki Tanuma, Tokyo (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 410 days.

(21) Appl. No.: 11/671,621

(22) Filed: Feb. 6, 2007

(65) Prior Publication Data

US 2007/0182788 A1 Aug. 9, 2007

(30) Foreign Application Priority Data

Feb. 7, 2006 (JP) ..... 2006-029865

(51) Int. Cl.
*B41J 2/05* (2006.01)

(52) U.S. Cl. ..... 347/62; 347/44

(58) Field of Classification Search ..... 347/9, 347/14, 17, 18, 20, 22, 35, 54, 55, 68, 70–72, 347/47

See application file for complete search history.

(56) References Cited

FOREIGN PATENT DOCUMENTS

| | | |
|---|---|---|
| JP | 05-201000 | 8/1993 |
| JP | 2002-79666 | * 3/2002 |
| JP | 2005-349687 | 12/2005 |

* cited by examiner

*Primary Examiner*—Juanita D Stephens
(74) *Attorney, Agent, or Firm*—DLA Piper LLP US

(57) ABSTRACT

Disclosed is an ink jet head driven by a drive IC for ejecting an ink droplet having conductivity, comprising a chamber for storing ink, a nozzle plate attached to the chamber, an actuator provided with an electrode electrically contacting ink in the chamber and activated by a current flowing through the electrode from a power supply, a conductive plate including an opening and glued to the nozzle plate such that the nozzle is exposed through the opening, and a current limiter limiting the current when the ink is purged from the nozzle during a period other than that of ink being ejected. Even if the purge is repeatedly carried out, an extraordinarily rising in temperature of the drive IC and resultant breakdown of the IC can be prevented.

6 Claims, 5 Drawing Sheets

INK JET HEAD

BACKGROUND OF THE INVENTION (1) Field of the Invention

The present invention relates to an ink jet head, and more particularly to an ink jet head including a current limiter for limiting a current flowing through ink when purging.

(2) Description of the Related Art

Japanese Patent Publication (Kokai) No. 2002-79666 discloses a conventional ink jet head 2*a* as is shown in FIG. 10. FIG. 10 is a cross section of a main portion of ink jet head 2*a*. A nozzle plate 4 is fixed to a tip of ink jet head 2*a*. A plurality of nozzles 5 are formed in nozzle plate 4 in a line such that each nozzle corresponds to a respective ink chamber 6. When current from a power supply flows through an electrode 10 disposed on an actuator 9 forming a part of ink chamber 6, actuator 9 deforms. Thus, ink is ejected from nozzle 5. A plate 7 having an opening is attached to nozzle plate 4 overlapping with nozzle 5 such that the ejected ink from nozzle 5 passes through the opening. Plate 7 prevents the tip of ink jet head 2*a* from being contaminated by ink seeping from nozzles 5.

If plate 7 is electrically ungrounded, friction between the surface of plate 7 and either a transferred recording paper or the flow of dried air produces static electricity on plate 7. The static electricity causes a discharge current to momentarily flow through a conductive member in ink jet head 2*a* and an integrated circuit (IC) for driving ink jet head 2*a*. If the discharge current is big, the IC may break down. To prevent such a breakdown, plate 7 is electrically grounded to have no charge thereon, using a conductive material therefore, e.g., stainless steel, nickel, aluminum, and so on.

Conventionally, an operation for purging ink, so called "purge", is also performed frequently to remove contaminants adjacent to the nozzles, e.g., ink having increased viscosity, bulky particles, and so on, thereby keeping ink ejection from the ink jet head stable. During purging, ink pressure generated in an ink chamber by an energized actuator causes ink to be forcibly pushed out or flushed out from the nozzles to remove the contaminants while the ink jet head is at rest and not in a printing operation.

Inventors of the present invention found that temperature of integrated circuit (IC) for driving the ink jet head goes extraordinarily high when the purge is repeated, thereby bringing about deterioration or breakdown of the IC.

SUMMARY OF THE INVENTION

An object of the present invention is to provide an ink jet head including a protective structure preventing a drive IC from experiencing extraordinary temperature rise and thermal breakdown, even when the purge is repeated, while preventing ink contaminants adjacent to nozzles.

To accomplish the above-mentioned object, an ink jet head which ejects conductive ink therefrom comprises:

a chamber configured to temporarily store ink;

a nozzle plate attached to the chamber, the nozzle plate including a nozzle through which ink is ejected;

an actuator configured to eject ink from the chamber, the actuator being provided with an electrode at least a part of which electrically contacts ink in the chamber, the actuator being activated by a current flowing through the electrode;

a conductive plate including an opening and attached to the nozzle plate such that the nozzle is exposed through the opening; and a current limiter configured to limit the current flowing through both the conductive plate and ink in the chamber when ink is purged from the nozzle in a period other than when ink is being ejected.

BRIEF DESCRIPTION OF THE DRAWINGS

These and other objects and advantages of this invention will become apparent and more readily appreciated from the following detailed description of the presently preferred exemplary embodiments of the invention taken in conjunction with the accompanying drawings wherein.

DETAILED DESCRIPTION OF THE INVENTION

Figure 1:
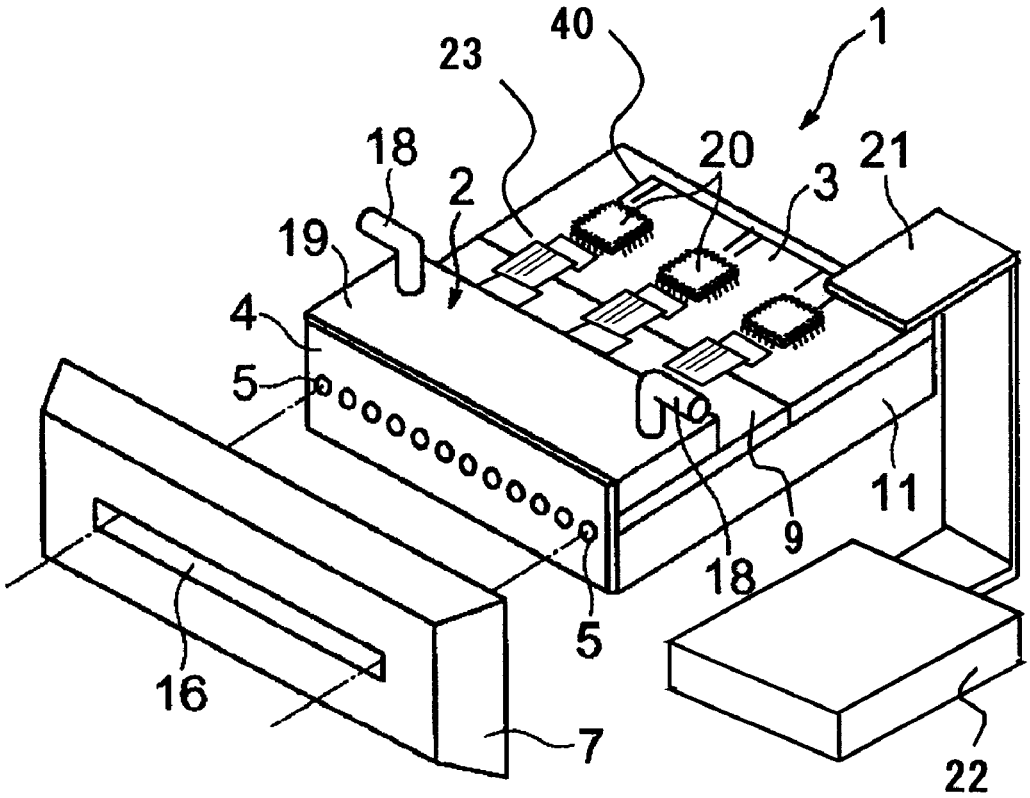
FIG. 1 is a perspective view of an ink jet head in an embodiment in the present invention.

The present invention will now be described in more detail with reference to the accompanying drawings. However, the same numerals are applied to the similar elements in the drawings, and therefore, the detailed descriptions thereof are not repeated.

Figure 2:
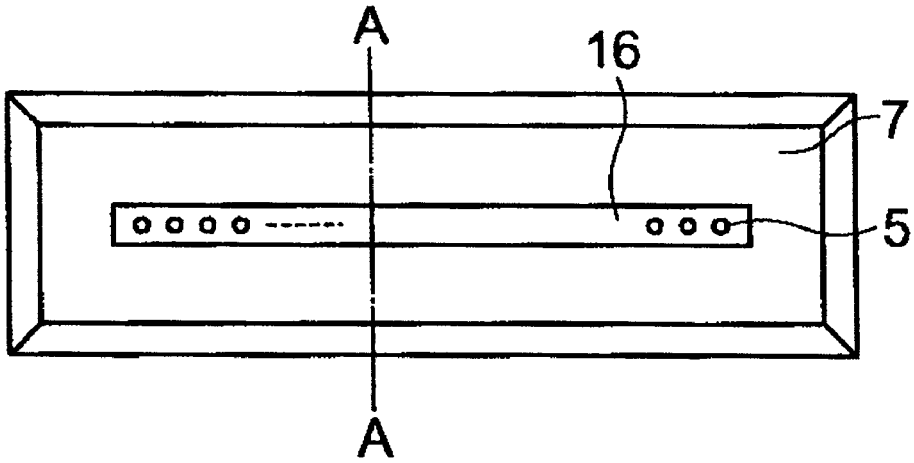
FIG. 2 is a plan view of a conductive plate seen from a nozzle side.
Figure 3:
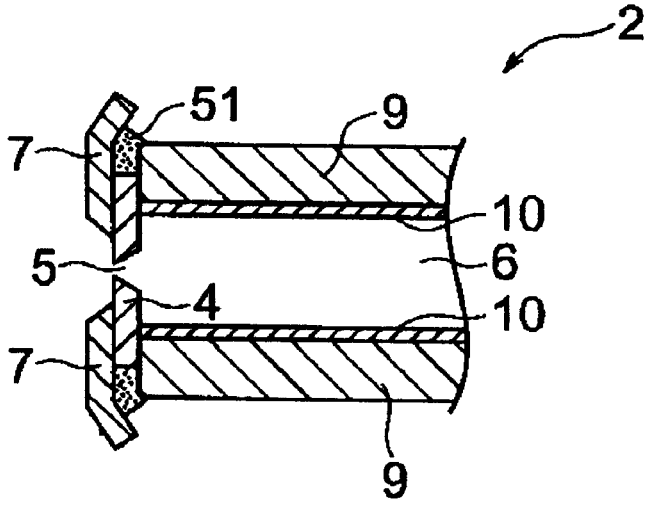
FIG. 3 is a partial cross-sectional view of a vicinity of a nozzle of the ink jet head.

A perspective view of an ink jet head unit 1 is shown in FIG. 1. A front view of ink jet head unit 1 is shown in FIG. 2. A cross sectional view of an ink jet head 2 in a vicinity of an actuator 9 and a nozzle 5, taken along with A-A line in FIG. 2, is shown in FIG. 3.

Ink jet head unit 1 comprises ink jet head 2 and a printed circuit board 3, both of which are mounted on a base plate 11. Generally, ink jet head unit 1 is referred to simply as "ink jet head." Printed circuit board 3 has mounted thereon a drive IC 20, i.e., an integrated circuit, including a control circuit and an electric power circuit 40 shown in FIG. 1 to energize actuator 9 included in ink jet head 2 and to control actuator 9 in accordance with a control signal. The control signal is supplied from an outside controller 22 through a connection cable 21 fixed to printed circuit board 3, accompanying with an electric power. To operate actuator 9, a flexible printed circuit board 23 is provided to electrically connect an electric terminal of IC 20 with an electrode 10 formed on actuator 9.

Ink jet head 2 comprises actuator 9, a top plate 19, a nozzle plate 4 having a plurality of nozzles 5 for ejecting ink, and a conductive plate 7. Top plate 19 is equipped with an ink supply tube 18 at a prescribed position. Ink is supplied through ink supply tube 18 to a pressure chamber 6 formed of actuator 9 and top plate 19. Pressure chamber 6 temporarily stores the ink. Nozzle plate 4 in which a plurality of nozzles are drilled is fixed on a side of actuator 9 and top plate 19 such that each nozzle 5 is fluidly communicated with respective pressure chambers 6. The diameter of each nozzle 5 is 30 μm. Electrode 10 is formed on actuator 9 to change capacity of pressure chamber 6 by applying a drive voltage to electrode 10 so as to eject an ink droplet from the nozzle 5. Since electrode 10 in pressure chamber 6 has no insulating layer in the present embodiment, ink in pressure chamber 6 is in contact with such the bare electrode 10 directly.

Conductive plate 7 having an opening 16 in a linear rectangle shape is glued to nozzle plate 4 with adhesive 51 such that nozzles 5 are exposed through opening 16 so as to pass an ejected ink from nozzles 5 therethrough. Opening 16 is formed in width of 1 mm and length containing all nozzles 5. As shown in FIG. 3, a shape of conductive plate 7 is made to have a plane and inclined side planes connected thereto, such as a boat shape, so that an inside surface of the boat shape fits entire surface of nozzle plate 4. A thickness of conductive plate 7 is 0.1 mm in the present embodiment. The thickness may be set to prevent a cleaning blade from exfoliating an ink repellent layer formed on a surface of nozzle plate 4 while a surface of conductive plate 7 is rubbed and cleaned by the cleaning blade during a rest of printing, and to prevent ink oozing out of nozzles 5 from creeping up along with the surface of nozzle plate 4. Conductive plate 7 may be formed of a metal, e.g., stainless steel, nickel, aluminum, brass, and so on, or a conductive resin made of mixture of an insulating resin and a conductive material, e.g., carbon fiber, carbon black powder and fiber metal. The insulating resin includes a thermoplastic, e.g., polyphenylene ether, polystyrene, polyimide, acryl, polyacetal, polycarbonate and mixture thereof. The conductive resin may have a resistance that a value thereof is in the middle between a metal and an insulating resin and is decided by the mixing ratio of the insulating resin and the conductive material.

Ink used in the present embodiment is an UV curable ink comprising a photo acid generating agent generating an acid upon irradiation with UV light, solvent that is polymerized in the presence of the acid, and pigment dispersed in the solvent. The ink has conductivity, that is to say that volume resistance of ink ranges from $10^5$ to $10^8$ Ωcm. Although the UV curable ink is adopted to the present embodiment, other type of ink, e.g., aqueous ink, solvent ink, and so on, having as much the volume resistivity as the UV curable ink may be available.

Figure 4:
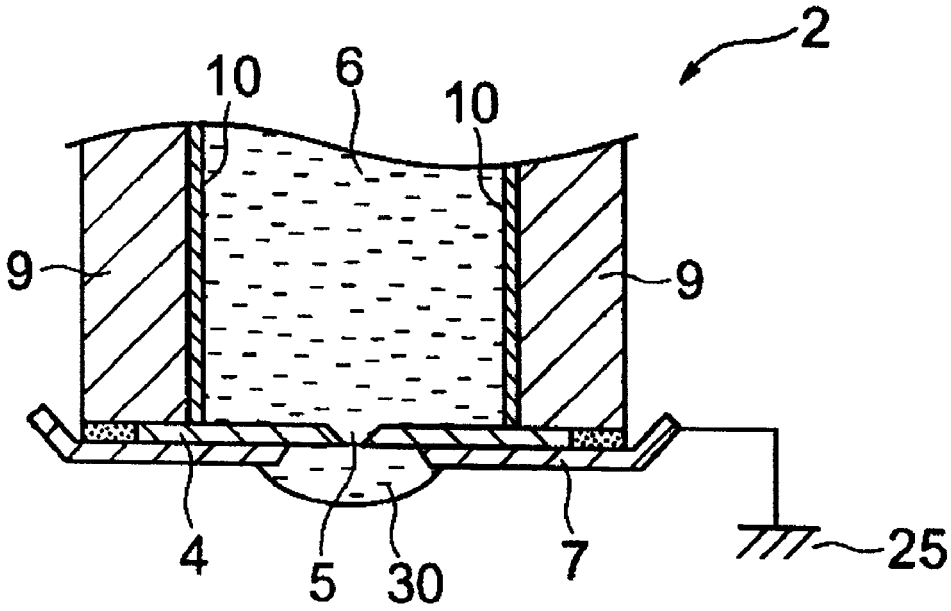
FIG. 4 is a partial cross-sectional view of an ink jet head showing a vicinity of a nozzle facing down.
Figure 5:
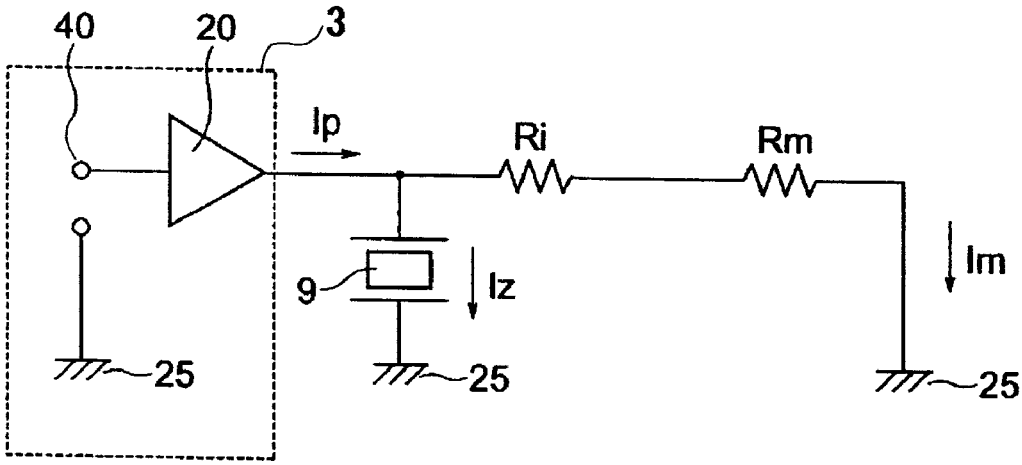
FIG. 5 is an equivalent circuit diagram explaining phenomena occurring when the purge is performed to reduce ink remained adjacent to a nozzle of an ink jet head.

Next, phenomena that the inventors observed when ink jet head 2 is operated to examine performance thereof is described with reference to FIGS. 4 and 5. Ink jet head 2 arranged such that nozzle plate 4 is directed downward and conductive plate 7 is grounded is shown in FIG. 4. An electrically equivalent circuit explaining a current path between ink jet head 2 and ground 25 when carrying out the purge is indicated in FIG. 5.

The performance examination was repeated while ink jet head 2 is operated. Stopping the operation for some time in the examination process causes ink residing in or adjacent to nozzles 5 to increase in viscosity due to the volatility of solvent contained in ink. The volatility causes ink to increase its fluid resistance, resulting in failure of ejecting the ink. For removing the ink having an increased viscosity, purge is repeatedly carried out to forcibly expel the ink residing in or adjacent to nozzles 5 by applying pressure generated by actuator 9 to the ink in pressure chamber 6. In FIG. 4 a protruding portion 30 of the ink pushed out from nozzles 5 and a surface of nozzle plate 4 around nozzles 5 are indicated when the purge is carried out. When the purge is frequently repeated, the surface temperature of IC 20 mounted on printed circuit board 3 rises extraordinarily high. In a state of high temperature of IC 20. repetition of the purge causes IC 20 to possibly malfunction due to further rising temperature.

Reason that IC 20 on ink jet head 2 brings about extraordinarily high temperature will be described. When voltage was applied to actuator 9 for the purge, unexpected current flowing from electric power supply 40 to ground 25 via IC 20 was observed. Such an unexpected current is generated for the reason that both volume resistance of ink used in the present embodiment has some $10^5$ to $10^8$ Ωcm, being comparatively low, and because the ink in protruding portion 30 remains at a step portion formed by a surface of nozzle plate 4 and an outside surface of conductive plate 7, the ink electrically connects electric power supply 40 to conductive plate 7.

Analysis to the phenomena discloses that, as indicated in the equivalent circuit, current path is formed in a system including electric power supply 40, IC 20, ink, conductive plate 7, and ground when the purge is carried out. Normally, current (Iz) flows from electric power supply 40 through actuator 9 to eject ink in accordance with the control signal. However, protruding portion 30 of the ink due to the purge forms another current path in which current (Im) flows to conductive plate 7 having resistance (Rm) through ink having volume resistance (Ri). Thus, current (Ip) flowing via IC 20 develops to an amount (Iz+Im) when the purge is carried out to clean the high viscosity ink remaining in or around nozzles 5. In the system, if both volume resistance of ink (Ri) and resistance of conductive plate 7 (Rm) go low, the current (Im) increases resulting in increasing the current (Ip).

Incidentally, in case that even if electrode 10 is passivated by an insulating layer it has a defect therein, e.g., a pin hole, a phenomena similar to the above may highly occur because current flows through the pin hole.

To prevent the phenomena upon the purge, four embodiments in the present invention will be now described.

FIRST EMBODIMENT

Figure 6:
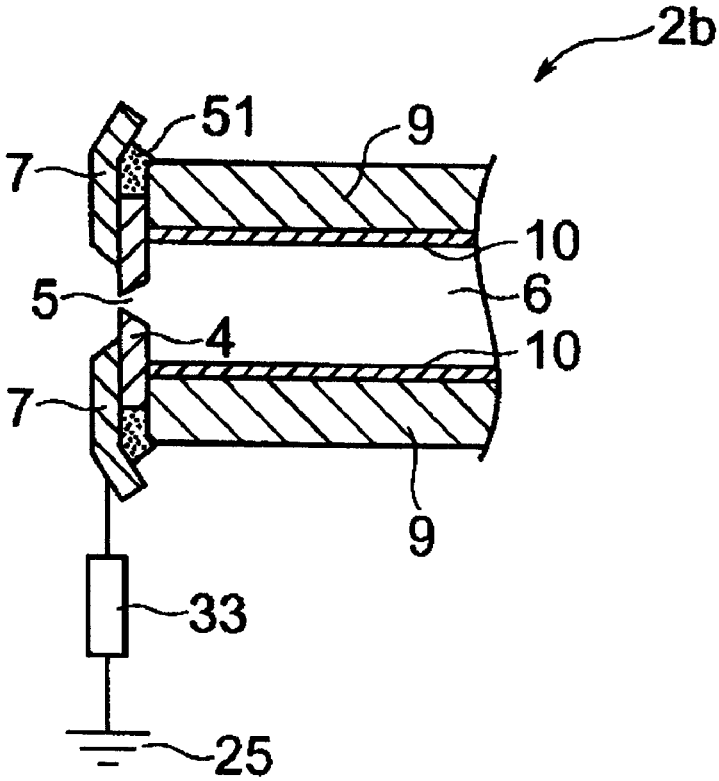
FIG. 6 is a partial cross-sectional view of an ink jet head showing a vicinity of a nozzle in the first embodiment.

An ink jet head 2*b* in the first embodiment will now be described with reference to FIG. 6, which illustrates a cross-sectional diagram thereof taken along with A-A line in FIG. 2. Conductive plate 7 made of a stainless steel is grounded through a resistance 33. One of the terminals of resistance 33 is soldered to conductive plate 7 and the other terminal thereof is connected with a ground of printed circuit board 3. Resistance 33 has $10^8$ Ω.

Resistance 33 can be selected to have a value of approximately 10 to $10^3$ times as high resistance as volume resistance of ink, considering power consumption or heat release value of IC 20.

Because resistance 33 functions to limit a discharge current between conductive plate 7 and ground 25, i.e., a current limiter, even if conductive plate 7 is charged by frictional electrification between a surface of conductive plate 7 and a transferred medium, application of resistance 33 achieves to prevent breakdown to IC 20.

Furthermore, even if conductive ink is used in ink jet head 2*b* and conductive plate 7 is conducted with electrode 10 via protruding portion 30 of the ink when the purge is carried out, increasing power consumption and heat release value of IC 20 and resultant breakdown of IC 20 can be prevented because current flowing from IC 20 to ground 25 is limited by resistance 33.

Incidentally, although resistance 33 in the present embodiment is utilized as a discrete component, alternative mounting method can be available in which a thick film resistance is formed by printing a resistive pattern of paste containing conductive powder on a part of ink jet head 2 and hardening it.

SECOND EMBODIMENT

Figure 7:
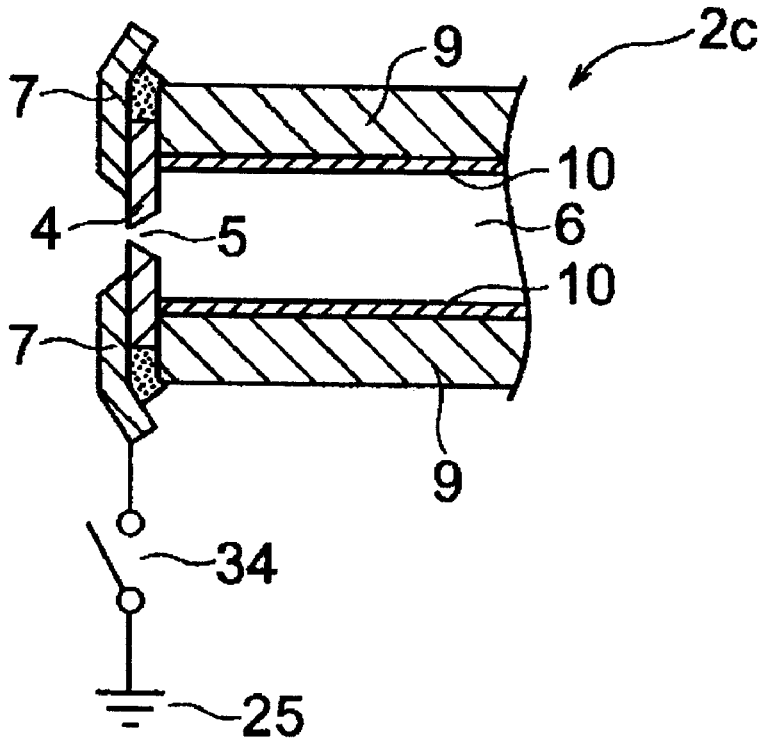
FIG. 7 is a partial cross-sectional view of an ink jet head showing a vicinity of a nozzle in the second embodiment.

An ink jet head 2*c* in the second embodiment is described in reference to FIG. 7. FIG. 7 is a cross sectional view of ink jet head 2*c* in a vicinity of nozzles 5. Conductive plate 7 made of a stainless steel is grounded through a switching element 34, acting as a current limiter, equipped on printed circuit board 3. The switching element for example includes a transistor, field effect transistor, and so on. Switching element 34 is controlled by outside controller 22 based on a printing signal either to insulate conductive plate 7, i.e., in an open state, while the purge is carried out or to ground conductive plate 7, i.e., in a close state, while printing process is carried out.

In this configuration, even if electrode 10 on actuator 9 is electrically connected with conductive plate 7 through the conductive ink upon the purge, current flowing from electric power supply 40 through IC 20 can be cut off by switching element 34. Cutting off the current achieves to prevent increasing power consumption and heat release value of IC 20 and resultant breakdown of IC 20.

Incidentally, in place of providing switching element 34 between conductive plate 7 and the ground, stopping current flowing from electric power supply 40 upon the purge can be made to obtain a similar effect. For example, current stop circuit for switching electric power supply 40 may be formed such that outside controller 22 stops current flowing from electric power supply 40 at the same time as a purge signal.

THIRD EMBODIMENT

Figure 8:
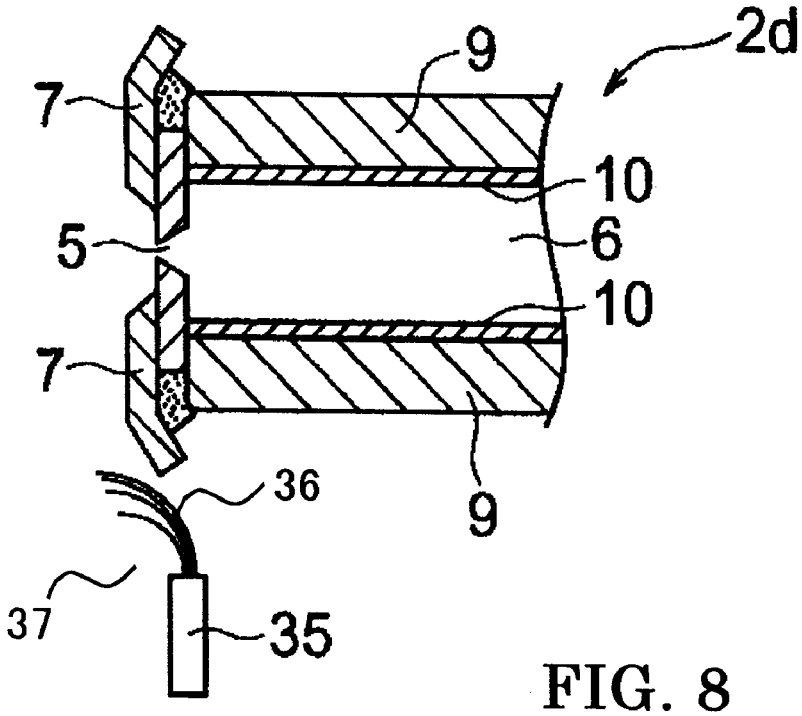
FIG. 8 is a partial cross-sectional view of an ink jet head showing a vicinity of a nozzle in the third embodiment.

An ink jet head 2*d* in the third embodiment is described with reference to FIG. 8. FIG. 8 is a cross section of ink jet head 2*d* in a vicinity of nozzles 5. Conductive plate 7 is made of a stainless steel. A discharge brush 37 serving as a current limiter is set on base plate 11 to contact with conductive plate 7 and remove a charge thereon. Discharge brush 37 comprises a bunch of carbon strings 36 and an aluminum holder 35 gripping one edge of the bunch. Aluminum holder 35 is grounded on printed circuit board 3. Resistance of discharge brush 37 is $10^8$ Ω.

Discharge brush 37 may be designed to have resistance value of approximately 10 to $10^3$ times as high as volume resistance of ink. If resistance of discharge brush 37 is less than a value of 10 times of the volume resistance of ink, a switching element described in the second embodiment may be available to cut off current upon the purge by providing the switching element between the aluminum holder 35 and a ground of printed circuit board 3.

Also in this configuration, even if conductive ink is used in ink jet head 2*d* and conductive plate 7 is conducted with electrode 10 via protruding portion 30 of the ink when the purge is carried out, increasing power consumption and heat release value of IC 20 and resultant breakdown of IC 20 can be prevented because current flowing through IC 20 to ground 25 is limited by discharge brush 37.

FOURTH EMBODIMENT

Figure 9:
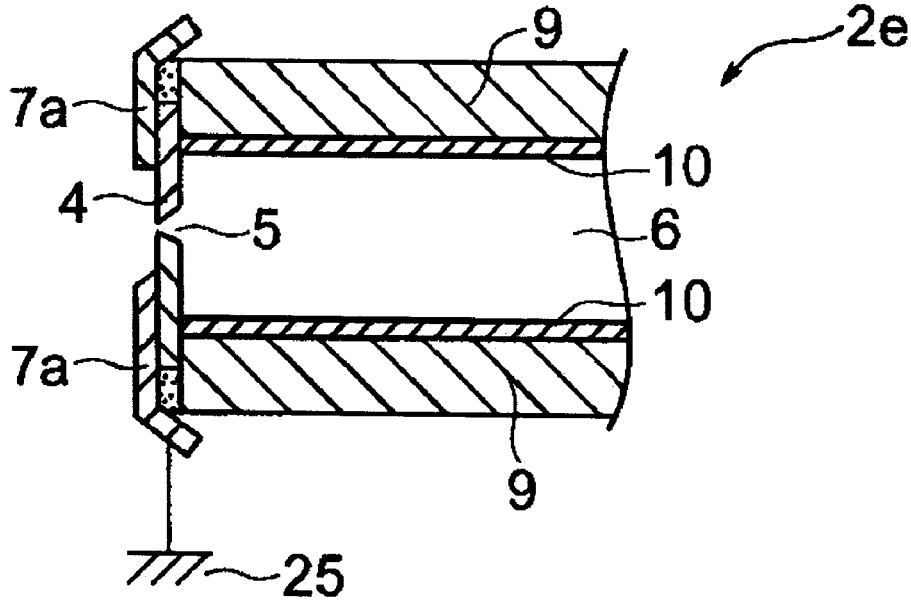
FIG. 9 is a partial cross-sectional view of an ink jet head showing a vicinity of a nozzle in the fourth embodiment.
Figure 10:
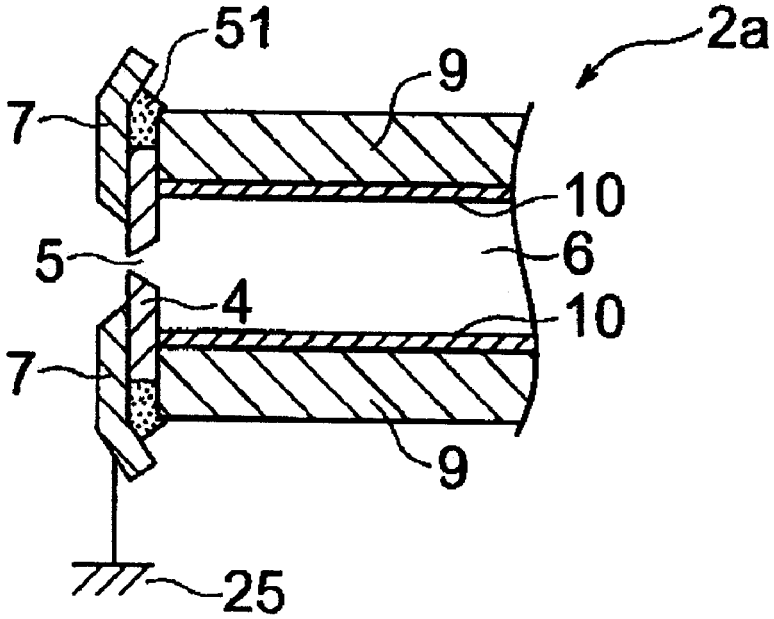
FIG. 10 is a partial cross-sectional view showing a vicinity of a nozzle in a conventional ink jet head.

An ink jet head 2*e* in the fourth embodiment is described in reference to FIG. 9. Except for a feature of conductive plate 7*a* ink jet head 2*e* is formed to be similar to ink jet heads 2*b* through 2*d* in the aforementioned embodiments. Conductive plate 7*a* is formed of a mixture of styrene resin and carbon black powder to have $10^{10}$ Ω. The styrene resin and carbon black powder are mixed in a desired mixing ratio to obtain the resistance and are molded into a boat shape. One edge of conductive plate 7*a* is connected with a ground on printed circuit board 3. Conductive plate 7*a* grounded serves as a current limiter.

In this structure, even if electrode 10 is conducted with conductive plate 7*a* via the conductive ink upon the purge, current flowing through IC 20 can be limited because conductive plate 7*a* has a prescribed resistance.

Incidentally, although the current limiters in the aforementioned embodiments are grounded, the other reference potential can be also available according to configuration of a drive circuit.

The present invention has been described with respect to specific embodiments. However, other embodiments based on the principles of the present invention should be obvious to those of ordinary skill in the art. Such embodiments are intended to be covered by the claims.

What is claimed is:

1. An ink jet head which ejects conductive ink therefrom, comprising:

a chamber configured to temporarily store ink;

a nozzle plate attached to the chamber, the nozzle plate including a nozzle through which ink is ejected;

an actuator configured to eject ink from the chamber, the actuator being provided with an electrode at least a part of which electrically contacts ink in the chamber, the actuator being activated by a current flowing through the electrode from a power supply;

a conductive plate including an opening and attached to the nozzle plate such that the nozzle is exposed through the opening; and a current limiter configured to limit the current flowing from the power supply through both the conductive plate and ink in the chamber when ink is purged from the nozzle in a period other than when ink is being ejected, wherein the current limiter is formed of a resistor provided between the conductive plate and the power supply.

2. An ink jet head according to claim 1, further comprising a control circuit controlling operation of the ink jet head and including the power supply, the control circuit being integrally mounted on the ink jet head.

3. An ink jet head which elects conductive ink therefrom comprising:

a chamber configured to temporarily store ink;

a nozzle plate attached to the chamber, the nozzle plate including a nozzle through which ink is ejected;

an actuator configured to eject ink from the chamber the actuator being provided with an electrode at least a part of which electrically contacts ink in the chamber, the actuator being activated by a current flowing through the electrode from a power supply;

a conductive plate including an opening and attached to the nozzle plate such that the nozzle is exposed through the opening; and a current limiter configured to limit the current flowing from the power supply through both the conductive plate and ink in the chamber when ink is purged from the nozzle in a period other than when ink is being ejected, wherein the current limiter includes a switch cutting off the current when the ink is purged, the switch being provided between the conductive plate and the power supply.

4. An ink jet head according to claim 3, further comprising a control circuit controlling operation of the ink jet head and including the power supply, the control circuit being integrally mounted on the ink jet head.

5. An ink jet head which ejects an ink droplet, comprising:

a chamber configured to temporarily store ink;

a nozzle plate attached to the chamber, the nozzle plate including a nozzle through which ink is ejected;

an actuator configured to eject ink from the chamber, the actuator being provided with an electrode at least a part of which electrically contacts ink in the chamber and activated by a current flowing through the electrode from a power supply; and a plate having a prescribed resistance value, the plate having an opening and being attached to the nozzle plate such that the nozzle is exposed through the opening.

6. An ink jet head according to claim 5, further comprising a control circuit controlling operation of the ink jet head and including the power supply, the control circuit being integrally mounted on the ink jet head.

* * * * *